US006843376B2

(12) United States Patent
Dube et al.

(10) Patent No.: US 6,843,376 B2
(45) Date of Patent: Jan. 18, 2005

(54) MOBILE SCREENING UNIT

(75) Inventors: Jean-Denis Dube, Notre-Dame-du-Portage (CA); Éric Houle, Bic (CA); Frédéric Gauvin, Riviére-du-Loup (CA)

(73) Assignee: Premier Tech 2000 Ltee (CA)

( * ) Notice: Subject to any disclaimer, the term of this patent is extended or adjusted under 35 U.S.C. 154(b) by 130 days.

(21) Appl. No.: 10/033,005

(22) Filed: Oct. 26, 2001

(65) Prior Publication Data

US 2002/0056668 A1 May 16, 2002

(30) Foreign Application Priority Data

Oct. 27, 2000 (CA) ..... 2324498

(51) Int. Cl.[7] ..... B07B 1/49

(52) U.S. Cl. ..... 209/421; 209/420; 209/234; 209/241

(58) Field of Search ..... 209/421, 420, 209/235, 234, 241, 247, 257, 261, 284, 288, 314, 667, 672, 662

(56) References Cited

U.S. PATENT DOCUMENTS

| | | | | |
|---|---|---|---|---|
| 517,724 A | | 4/1894 | Beers | |
| 2,115,110 A | | 4/1938 | Keil | 209/326 |
| 2,366,222 A | | 1/1945 | Tocci-Guilbert | 209/44 |
| 2,703,649 A | | 3/1955 | Cheyette | 209/314 |
| 2,706,046 A | * | 4/1955 | Andrews | 209/283 |
| 2,864,561 A | | 12/1958 | Mork | 241/24 |
| 2,922,510 A | * | 1/1960 | Zetterlund | 198/582 |
| 3,162,600 A | * | 12/1964 | Montgomery | 209/259 |

FOREIGN PATENT DOCUMENTS

| | | |
|---|---|---|
| AU | 212642 | 2/1958 |
| DE | 285882 | 1/1991 |
| GB | 1553667 | 10/1979 |
| IR | 64987 | 9/1995 |
| IR | 74896 | 8/1997 |
| RU | 1488026 | 6/1989 |
| WO | 9741971 | 11/1997 |

(List continued on next page.)

*Primary Examiner*—Donald P. Walsh
*Assistant Examiner*—M Kohner
(74) *Attorney, Agent, or Firm*—St. Onge Steward Johnston & Reens, LLC

(57) ABSTRACT

A mobile screening unit for screening bulk material. The screening unit comprises a first screener, a second screener, and an elongated mobile support frame having a longitudinal axis. The first screener is mounted to the support frame and extends longitudinally thereon. The first screener has an inlet for receiving the bulk material containing large-sized, medium-sized, and small-sized particles. The first screener also has a first outlet for releasing large-sized particles and a second outlet for releasing medium-sized and small-sized particles. The first screener is used for screening the bulk material along a first direction substantially parallel to the longitudinal axis of the support frame. The second screener is mounted to the support frame and extends longitudinally thereon. The second screener has an inlet for receiving medium-sized and small-sized particles conveyed from the first screener and also has a first outlet for releasing medium-sized particles and a second outlet for releasing small-sized particles. The second screener is used for screening the medium-sized particles from the small-sized particles along a second direction substantially parallel to the longitudinal axis of the support frame. The mobile screening unit enables to screen bulk material containing particles of different sizes into at least three different piles, each pile containing particles of substantially the same size.

13 Claims, 8 Drawing Sheets

U.S. PATENT DOCUMENTS 3,316,977 A * 5/1967 Snook ..... 171/25
3,439,806 A * 4/1969 Kass et al. ..... 209/260
3,909,401 A * 9/1975 Thompson ..... 209/412
4,256,572 A 3/1981 Read ..... 209/257
4,303,506 A * 12/1981 Finlay ..... 209/247
4,363,725 A 12/1982 Morita et al. ..... 209/257
4,572,782 A * 2/1986 Smith et al. ..... 209/236
4,591,432 A * 5/1986 Hartl ..... 209/247
4,861,461 A 8/1989 Utterback ..... 209/234
4,879,023 A * 11/1989 Mallaghan ..... 209/241
4,923,597 A * 5/1990 Anderson et al. ..... 209/420
4,948,299 A * 8/1990 Cronk et al. ..... 405/179
4,956,078 A 9/1990 Magerowski et al. ..... 209/254
4,983,280 A 1/1991 Eriksson ..... 209/241
5,097,610 A 3/1992 Bishop ..... 37/142.5
5,100,537 A 3/1992 Krause ..... 209/2
5,106,490 A 4/1992 McDonald ..... 209/240
5,120,433 A 6/1992 Osadchuk ..... 209/235
5,183,160 A * 2/1993 McClain ..... 209/234
5,234,564 A 8/1993 Smith ..... 209/241
5,248,042 A 9/1993 Kuhmonen ..... 209/234
5,285,905 A * 2/1994 Laprade ..... 209/288
5,346,071 A * 9/1994 Page et al. ..... 209/257
5,379,951 A * 1/1995 Hughes ..... 241/60
5,482,165 A * 1/1996 Johnston ..... 209/244
5,577,618 A * 11/1996 Rafferty ..... 209/421
5,740,922 A * 4/1998 Williams ..... 209/668
5,794,787 A * 8/1998 Johnston ..... 209/420
5,819,950 A 10/1998 McCloskey ..... 209/241
5,842,578 A * 12/1998 Cordeiro ..... 209/420
5,860,533 A * 1/1999 Wood ..... 209/308
5,865,317 A * 2/1999 Clinton ..... 209/12.1
5,899,340 A * 5/1999 MacNaughton ..... 209/325
5,921,401 A * 7/1999 Johnston ..... 209/315
5,927,513 A * 7/1999 Hart ..... 209/677
5,957,302 A * 9/1999 Douglas ..... 209/421
5,975,441 A 11/1999 Burkholder ..... 241/24.12
5,979,666 A * 11/1999 Douglas ..... 209/241
6,000,553 A * 12/1999 Cohen et al. ..... 209/313
6,000,554 A * 12/1999 Hughes ..... 209/314
6,006,921 A * 12/1999 Zehr ..... 209/288
6,065,606 A * 5/2000 Bonner ..... 209/420
6,098,812 A * 8/2000 Douglas ..... 209/420
6,152,308 A * 11/2000 Kreiser et al. ..... 209/421
6,315,129 B1 * 11/2001 Graney ..... 209/421
6,336,558 B1 * 1/2002 Douglas ..... 209/421
6,367,633 B1 * 4/2002 Douglas ..... 209/311
6,382,424 B1 * 5/2002 Bolton et al. ..... 209/405
6,382,425 B1 * 5/2002 Brickner et al. ..... 209/421
6,405,874 B1 * 6/2002 Douglas ..... 209/421

* cited by examiner

MOBILE SCREENING UNIT

FIELD OF THE INVENTION

The present invention relates to a screening unit. More particularly, the present invention relates to a mobile screening unit for screening bulk material containing particles of different sizes into at least three different piles, each pile containing particles of substantially the same size.

BACKGROUND OF THE INVENTION

It is well known in the art that there are several technologies for screening bulk material composed of products such as moulds, composts, wood residues, aggregates, etc. These technologies include the use of rotating screeners, star screeners, vibrating screeners, etc. The rotating screeners and the star screeners are much more performant with organic products, such as moulds, composts and wood residues for example, for obtaining end products of small granular sizes (½" and less, for example) and at high production rates (approximately 150 cubic yards/hour and more, for example). However, these types of screeners are not compatible with inputs of great dimensions such as big rocks, big wooden pieces or big cement blocks, because the latter can easily damage the screens of the rotating screeners or damage the stars and the shafts of the star screeners.

Also known in the art are vibrating screeners which can be used for accepting the above-mentioned larger-sized products. These types of screeners are known to be efficient for screening aggregates. However, their production capacity for obtaining end products of small granular sizes from organic materials is fairly limited. Also, the screens or the perforated plates used with these vibrating screeners often get plugged up when the bulk material to be screened is humid.

In order to avoid the damaging of their rotating screeners or star screeners which are mostly used for screening organic material, several manufacturers will often use a vibrating screen placed over the material reserve used for feeding their rotating or star screeners. This vibrating screen is primarily used for carrying out a primary screening of the inputs of great dimensions in order to then direct the bulk material, free of large debris, into the rotating screener, or star screener. However, in the prior art, the direction of flow of the bulk material onto the vibrating screen is perpendicular to that of the reserve and that of the rotating screener, thus is perpendicular to the longitudinal axis of the screening unit machine. This limits drastically the length allowable for the vibrating screen due to the maximal dimensions allowed for the screening unit for travelling on the road. In fact, the length of the screener is then limited to the width of the screening unit machine which is itself limited to 8'6" or 8"3" in most countries in order to be legally allowed to travel on the roads.

Since the length of the vibrating screener or of the vibrating screen is limited, the amount of material that can be unloaded therein with a loader or an excavator is also therefore limited. In fact, if the amount of material unloaded is too great, it causes an overflow of bulk material outside the vibrating screener at the bottom thereof because the retention time of the material is not sufficient enough for it to flow completely through the screen. An important amount of small-sized and medium-sized product finds itself thus with the large-sized products of the bulk material. One must thus decrease the amount of bulk material unloaded onto the vibrating screener or the vibrating screen in order to obtain a suitable classification. Furthermore, the debris of great dimensions slide to the bottom of the vibrating screen, close to the location where the loader must position itself for unloading the bulk material on the same. The operator of the loader must thus clean this area at frequent intervals in order to be able to feed the machine in a suitable and safe manner. All of the above factors lead to a decrease in screening productivity.

Furthermore, there exist vibrating screeners provided with two stages of screening which enable to accept inputs of great dimensions at the upper stage and carry out a selection of precise granular size at the lower stage. However, the capacity of production of products in bulk and the capacity of screening of humid products is not as important with this type of screener as with star screeners or rotating screeners.

Known to the applicant are the following U.S. and foreign patents which describe different screening processes and apparatuses: U.S. Pat. Nos. 517,724; 2,115,110; 2,366,222; 2,703,649; 2,864,561; 3,322,354; 4,256,572; 4,363,725; 4,861,461; 4,956,078; 4,983,280; 5,097,610; 5,100,537; 5,106,490; 5,120,433; 5,234,564; 212642 (Australia); 64987 (Ireland); 74896 (Ireland); 285 882 (Germany); 1,553,667 (London); 1488026 (U.S.S.R.).

SUMMARY OF THE INVENTION

An object of the present invention is to provide a mobile screening unit which would overcome some of the above-mentioned problems, and would thus be an improvement over the mobile screening units known in the prior art.

In accordance with the invention, the above object is achieved by a mobile screening unit for screening bulk material, the screening unit comprising:

- an elongated mobile support frame having a longitudinal axis;
- a first screener mounted to the support frame and extending longitudinally thereon, the first screener having:
  - an inlet for receiving bulk material containing large-sized, medium-sized, and small-sized particles,
  - a first outlet for releasing large-sized particles,
  - a second outlet for releasing medium-sized and small-sized particles, the first screener being used for screening the bulk material along a first direction substantially parallel to the longitudinal axis of the support frame; and
- a second screener mounted to the support frame and extending longitudinally thereon, the second screener having:
  - an inlet for receiving medium-sized and small-sized particles conveyed from the first screener,
  - a first outlet for releasing medium-sized particles, and
  - a second outlet for releasing small-sized particles, the second screener being used for screening the medium-sized particles from the small-sized particles along a second direction substantially parallel to the longitudinal axis of the support frame;
- a feeding hopper mounted to the support frame for accumulating bulk material, the feeding hopper having an inlet for receiving bulk material and an outlet for releasing bulk material;
- a feeding conveyor positioned to receive the bulk material released from the outlet of the feeding hopper and convey the same in the first direction to the inlet of the first screener; and
- a transition conveyor mounted to the support frame and extending longitudinally thereon, the transition conveyor being positioned to receive the medium-sized and small-sized particles released from the second outlet of the first screener and convey the same in the second direction to the inlet of the second screener.

Also according to the present invention, there is provided a screening method for screening bulk material, said method being characterized in that it comprises the steps of:

a) accumulating into a feeding hopper bulk material containing large-sized, medium-sized, and small-sized particles;

b) receiving the bulk material from the feeding hopper:

c) screening large-sized particles from medium-sized and small-sized particles along a first longitudinal direction;

d) receiving medium-sized and small-sized particles obtained in a step (c); and e) screening medium-sized particles from small-sized particles along a second longitudinal direction substantially parallel to the first longitudinal direction.

Preferably, step (b) comprises the step of receiving the bulk material in a direction substantially parallel to the first longitudinal direction.

Preferably also, step (d) comprises the step of receiving medium-sized and small-sized particles in a direction substantially parallel to the second longitudinal direction.

The invention and its advantages will be better understood upon reading the following non-restrictive description of a preferred embodiment thereof, made with reference with the accompanying drawings.

DETAILED DESCRIPTION OF A PREFERRED EMBODIMENT OF THE INVENTION

Figure 1:
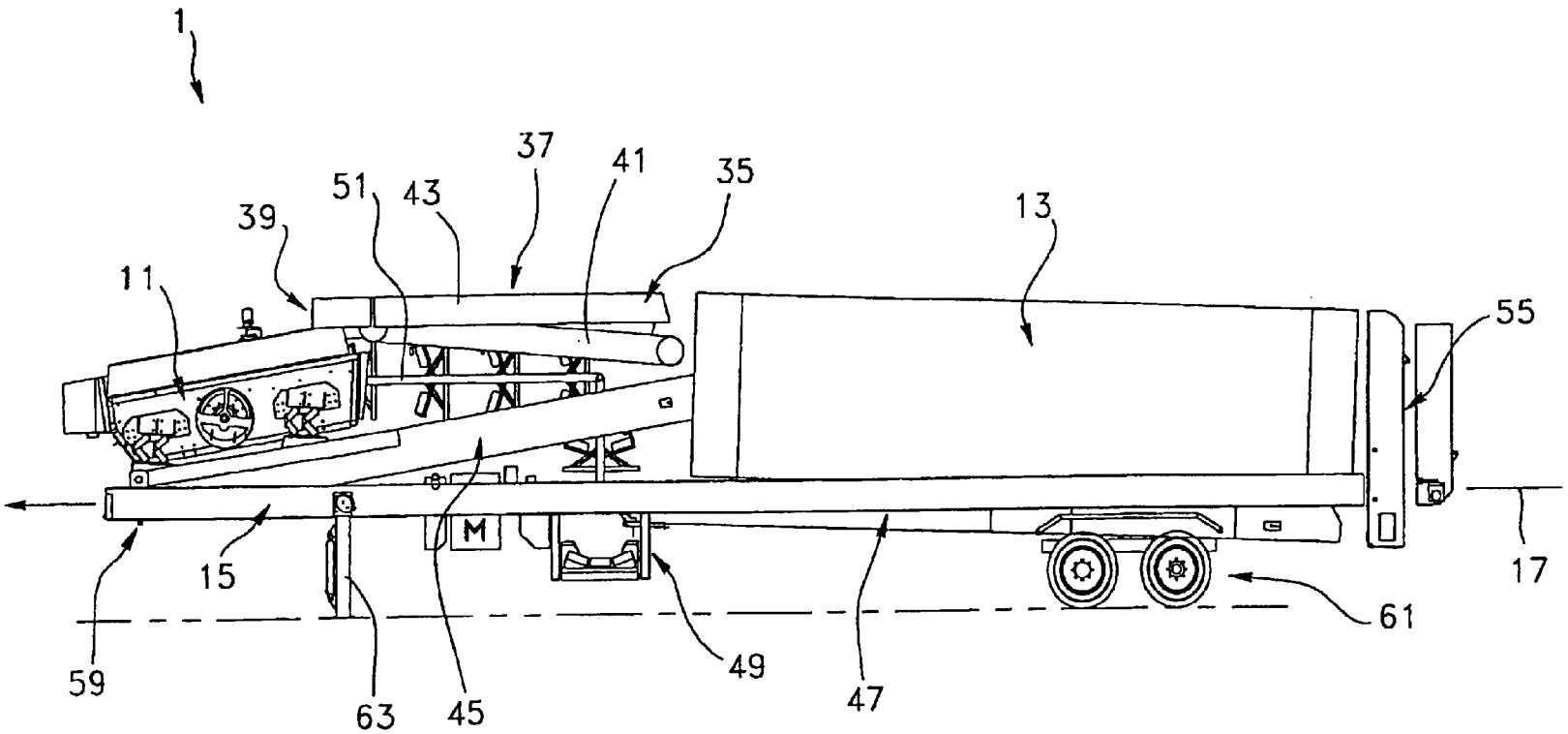
FIG. 1 is a side elevational view of the mobile screening unit according to a preferred embodiment of the invention, the mobile screening unit being shown in a transportation configuration.

In the following description, the same numeral references refer to similar elements. The embodiments shown in the figures are preferred.

Moreover, although the present invention was primarily designed for screening bulk material relating to the fields of compost, construction and demolition, contaminated soils, wood waste/top soil, peat moss and the like, etc., it could be used in different fields for other screening purposes, such as in the food or the agricultural industry for screening bulk material containing grains of different sizes for example, as apparent to a person skilled in the art. For this reason, expressions such as "pieces" and/or "blocks" and any other references and/or other expressions equivalent thereto should not be taken as to limit the scope of the present invention and include all other objects and all other purposes with which the present invention could be used and may be useful.

In addition, although the preferred embodiment of the mobile screening unit as shown comprises various components such as a feeding hopper, piling conveyors, retractable side panels, etc., not all of these components are essential to the invention and thus should not be taken in their restrictive sense, i.e. should not be taken as to limit the scope of the present invention. It is to be understood, as also apparent to a person skilled in the art, that other suitable components and cooperations thereinbetween may be used for the mobile screening unit according to the present invention, as will be explained hereinafter, without departing from the scope of the invention.

Furthermore, although the preferred embodiment of the first and second screeners of the mobile screening unit as shown in the accompanying drawings consist of a vibrating screener and a rotating screener respectively, it is also to be understood that the terms "vibrating" and "rotating" should not be taken in their restrictive sense, i.e. should not be taken as to limit the scope of the present invention, since other suitable screeners may be used respectively for the first and the second screener of the mobile screening unit depending on the particular applications of the mobile screening unit and the desired screening of the different types of particles composing the bulk material, as also apparent to a person skilled in the art. For example, the first and second screeners may be any one of the following: a vibrating screener, a disc screener, a star screener, a rotating screener, a satellite screener, a gyratory screener, or a double-stage vibrating screener, depending on the intended applications of the mobile screening unit, as apparent to a person skilled in the art.

Moreover, expressions such as "large", "great", and "big" as well as any equivalent expressions and/or compound words thereof, may be used interchangeably in the context of the present description. The same applies for any other mutually equivalent expressions, such as "medium" and "average" for example, as well as "small" and "fine", as also apparent to a person skilled in the art.

Finally, it is to be understood that the expression "particles", as used in the context of the present description, refers to various types of objects/substances which may be screened with the present invention, as also apparent to a person skilled in the art and as will be explained hereinafter.

Figure 2:
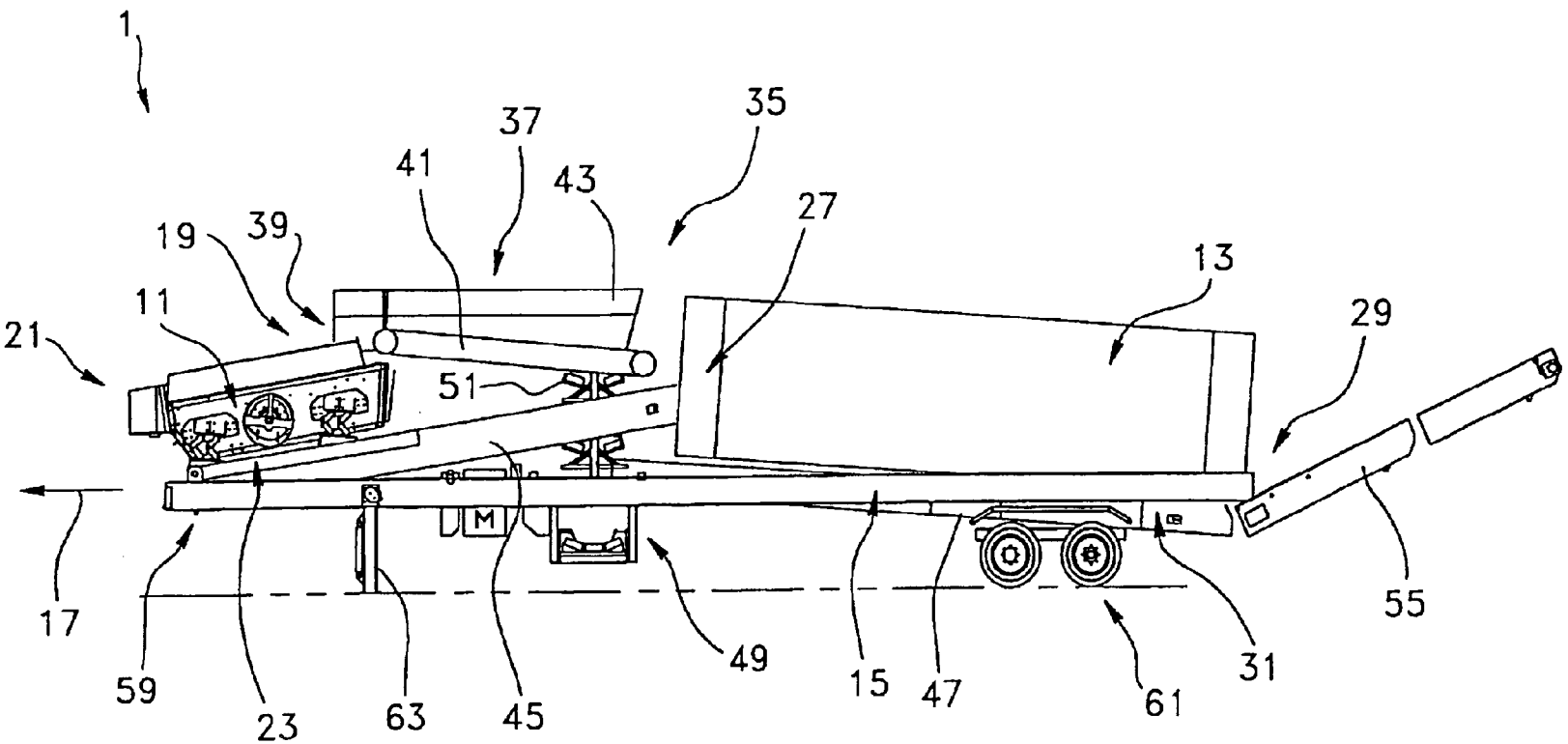
FIG. 2 is the same side view as in FIG. 1, showing the mobile screening unit in a working configuration.
Figure 3:
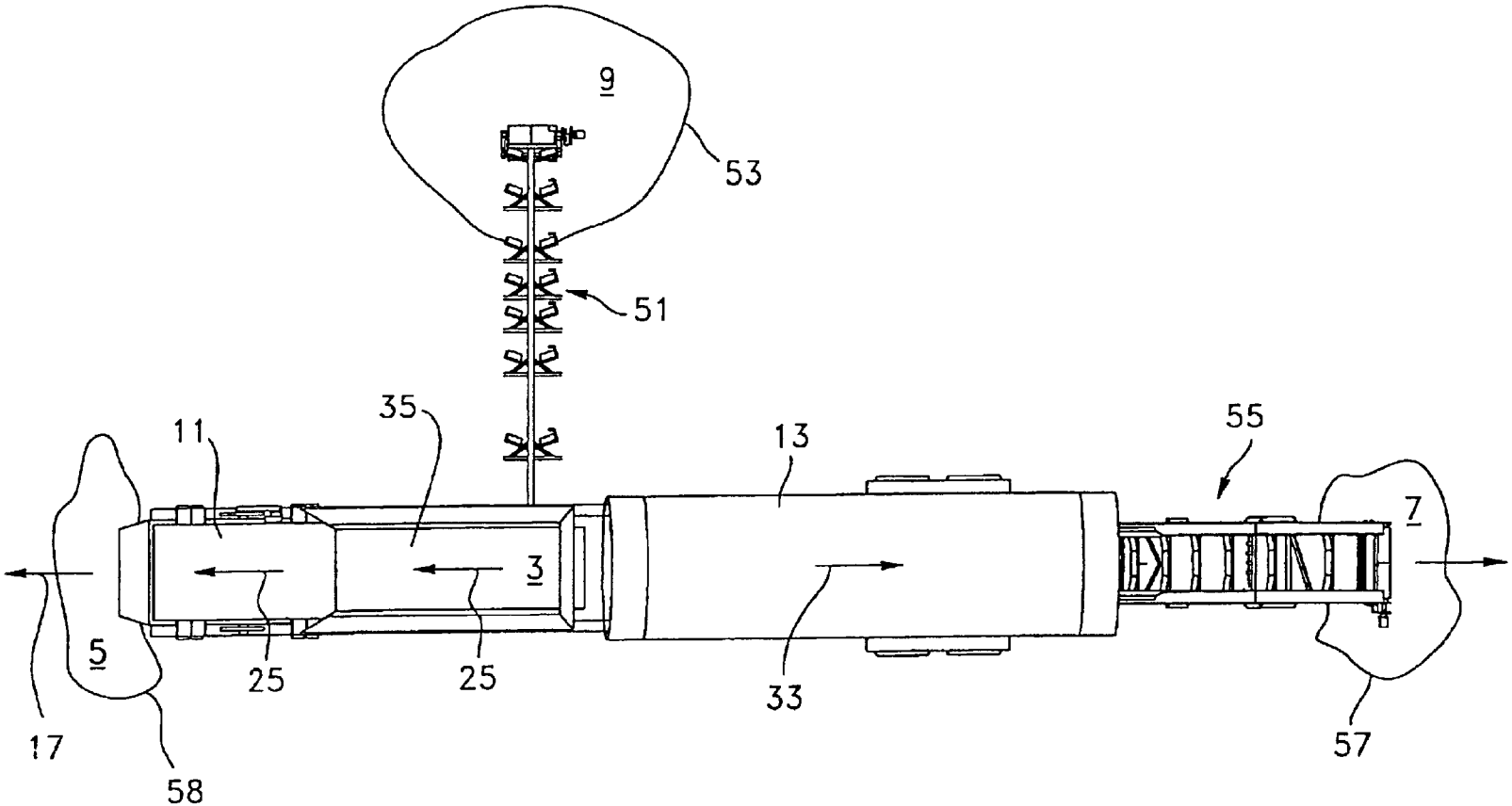
FIG. 3 is a top view of the mobile screening unit shown in FIG. 2.

Broadly described, and referring to FIGS. 1 to 3, the screening unit 1 illustrated in the accompanying drawings is a mobile screening unit 1 for screening bulk material 3 containing at least large-sized, medium-sized, and small-sized particles 5,7,9. The screening unit 1 comprises a first screener 11, a second screener 13, and an elongated mobile support frame 15 having a longitudinal axis 17. The first screener 11 is mounted to the support frame 15 and extends longitudinally thereon. The first screener 11 has an inlet 19 for receiving the bulk material 3, a first outlet 21 for releasing large-sized particles 5, and a second outlet 23 for releasing medium-sized and small-sized particles 7,9. The first screener 11 is used for screening the bulk material 3 along a first direction 25 substantially parallel to the longitudinal axis 17 of the support frame 15, as better shown in FIG. 2. The second screener 13 is also mounted to the support frame 15 and extends longitudinally thereon. The second screener 13 has an inlet 27 for receiving medium-sized and small-sized particles 7,9 conveyed from the first screener 11, a first outlet 29 for releasing medium-sized particles 7, and a second outlet 31 for releasing small-sized particles 9. The second screener 13 is used for screening the medium-sized particles 7 from the small-sized particles 9 along a second direction 33 substantially parallel to the longitudinal axis 17 of the support frame 15, as also better shown in FIG. 2.

Although the first and second directions 25, 33 as illustrated in the accompanying drawings are directed in opposite ways, for example in FIG. 3, the first direction points to the left whereas the second direction 33 points to the right, it is worth mentioning that the mobile screening unit 1 and the components thereof, namely but not exclusively the first and second screeners 11, 13, may be disposed otherwise so that both directions 25, 33 point towards the same way, as apparent to a person skilled in the art, so long as the directions 25, 33 are disposed along the longitudinal axis 17 of the support frame 15, according to the present invention.

As shown in FIGS. 1–3, the mobile screening unit 1 comprises a feeding hopper 35 for accumulating the bulk material 3. The feeding hopper 35 is preferably mounted to the support frame 15 and extends longitudinally thereon between the first screener 11 and the second screener 13, as better shown in FIGS. 2 and 3. The feeding hopper 35 has an inlet 37 for receiving the bulk material 3 and an outlet 39 for feeding the first screener 11. As also shown, the mobile screening unit 1 preferably also has a feeding conveyor 41 positioned to receive the bulk material 3 from the outlet 39 of the feeding hopper 35 and convey the same in the first direction 25 to the inlet 19 of the first screener 11. Preferably also, the feeding hopper 35 comprises retractable rear and lateral side panels 43.

Similarly to the above-mentioned, it is worth noting that although the feeding hopper 35 is preferably mounted between the first screener 11 and the second screener 13 as illustrated in the accompanying drawings, the mobile screening unit 1 and the components thereof, namely but not exclusively the feeding hopper 35, and the first and second screeners 11, 13, may be disposed otherwise by suitable cooperations thereinbetween, i.e. the feeding hopper 35 need not be necessarily located between the first and second screeners 11, 13, as apparent to a person skilled in the art.

As shown in FIGS. 1 and 2, the feeding hopper 35 is preferably positioned in the central portion of the mobile screening unit 1. The feeding hopper 35 is intended, among other things, to receive and to accumulate the raw bulk material 3 to be screened. The bulk material 3 may be loaded onto the feeding hopper 35 by appropriate feeding means such as a loader, an excavator, a mechanical shovel or even an auxiliary conveyor for example. Preferably also, the bulk material 3 is in turn fed to the first screener 11 by the feeding hopper 35. The feeding hopper 35 preferably comprises two lateral side panels 43 and a rear side panel 43 mounted over the feeding conveyor 41 which enables to feed the first screener 11 equally and continuously. The lateral side panels 43 and the rear side panel 43 are preferably provided with appropriate pivoting devices enabling them to be folded back during transportation of the mobile screening unit 1 in order not to exceed the maximal height allowable for circulation on the roads. The side panels 43 are deployed in the working position, as shown in FIG. 2, in order to increase the capacity of the feeding hopper 35. The direction of flow of the bulk material 3 in the feeding hopper 35, on the feeding conveyor 41, is preferably done along the longitudinal axis of the support frame 15 which enables the feeding hopper 35 to have side panels 43 having a length of at least 12'. This enables, among other things, to load the feeding hopper 35 by the side of the mobile screening unit 1 with most models of loading shovels known in the industry (the shovels of the loaders used in the industry have generally a length located between 9' and 12').

Preferably also and as better shown in FIGS. 1 and 2, the mobile screening unit 1 also comprises a transition conveyor 45 mounted to the support frame 15 and extending longitudinally thereon. The transition conveyor 45 is positioned to receive the medium-sized and small-sized particles 7,9 released from the second outlet 23 of the first screener 11 and convey the same in the second direction 33 to the inlet 27 of the second screener 13.

Preferably also and as better shown in FIGS. 1 and 2, the mobile screening unit 1 comprises a recovering conveyor 47 mounted to the support frame 15 and extending longitudinally thereon. The recovering conveyor 47 is positioned to receive the small-sized particles 9 released from the second outlet 31 of the second screener 13 and convey the same in the first direction 25 to an outlet end 49 thereof.

Preferably also and as better shown in FIGS. 2 and 3, the mobile screening unit 1 also comprises a first piling conveyor 51 mounted to the support frame 15 for receiving the small-sized particles 9 from the outlet end 49 of the recovering conveyor 47 and forming a pile 53 of small-sized particles 9 aside from the support frame 15. The piling conveyor 51 is preferably movable with respect to the support frame 15 between a folded position where it is folded against the support frame 15 along the longitudinal axis 17 thereof and an extended position where it extends in perpendicular to the longitudinal axis 17 of the support frame 15.

As better shown in FIGS. 1–3, the mobile screening unit 1 preferably also comprises a second piling conveyor 55 mounted to a rear end of the support frame 15 for receiving the medium-sized particles 7 released from the first outlet 29 of the second screener 13 and forming a pile 57 of medium-sized particles 7 at the rear of the support frame 15, as better shown in FIG. 3. This piling conveyor 55 is preferably movable between a folded position where it is folded against the rear end of the support frame 15, as better shown in FIG. 1, and an extended position where it extends in the same line as the support frame 15, as better shown in FIG. 2.

Figure 5:
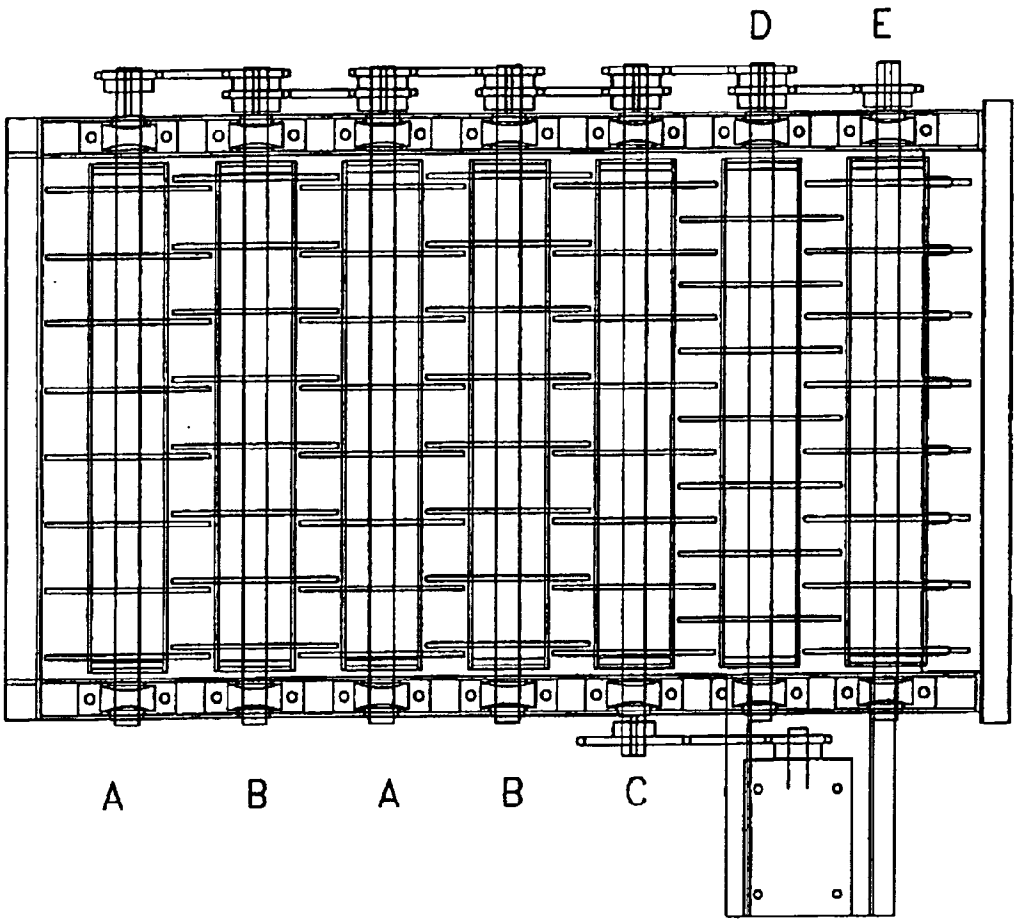
FIG. 5 is a partial top view of a disc screener suitable for use with the mobile screening unit of FIG. 1.
Figure 7:
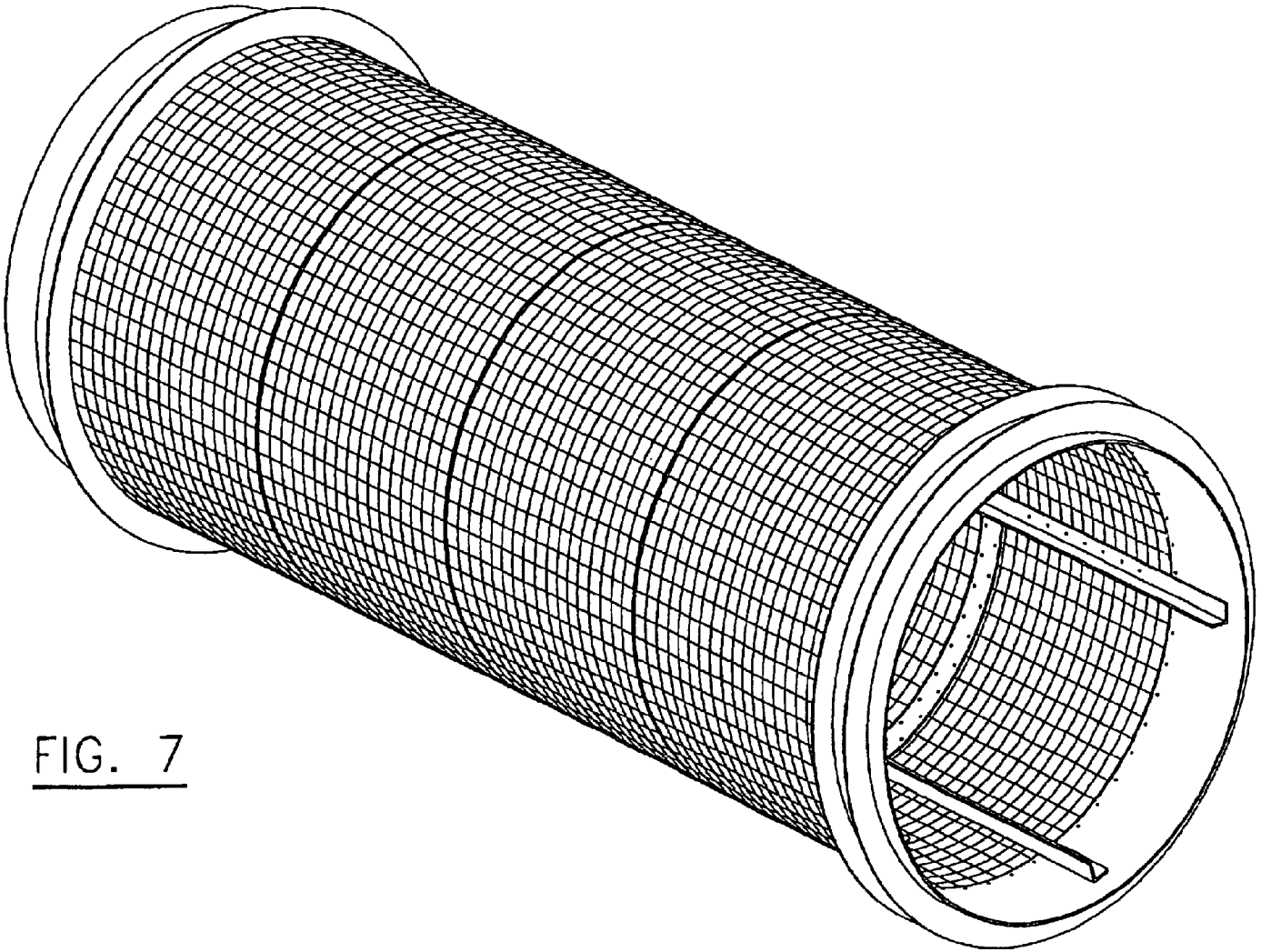
FIG. 7 is a perspective view of a rotating screener suitable for use with the mobile screening unit of FIG. 1.

According to the particular embodiment of the invention illustrated in FIGS. 1–3, the first screener 11 preferably consists of a vibrating screener, such as the one illustrated in FIG. 5, whereas the second screener 13 preferably consists of a rotating screener, such as the one illustrated in FIG. 7.

Figure 4:
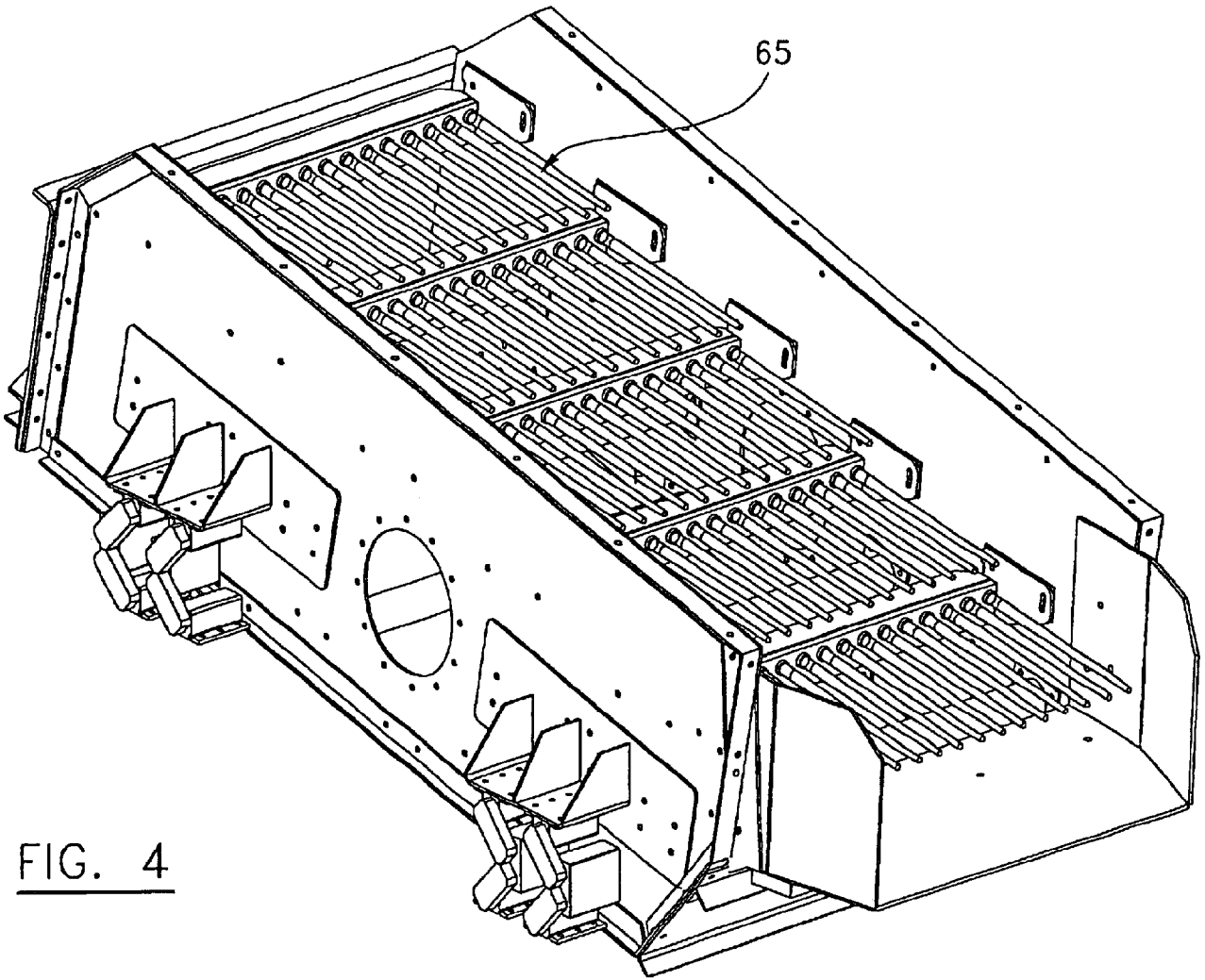
FIG. 4 is a perspective view of a vibrating screener suitable for use with the mobile screening unit of FIG. 1.

In this particular case, the vibrating screener is preferably actuated by an eccentric shaft with a counterbalancing weight and preferably comprises a stage of fingers 65 in order to carry out the primary screening of the large-sized particles 5 contained in the bulk material 3. The stage in question of the vibrating screener is preferably composed of several sections of fingers 65 disposed in a cascading configuration, as better shown in FIG. 4, in order to create a shaking effect onto the bulk material 3 moving along the screener 11. Each section of fingers 65 preferably contains a plurality of fingers 65 disposed in parallel according to a desired spacing. Preferably, the bulk material 3 to be screened is unloaded directly at the inlet 19 of the first screener 11 on the first section of fingers 65 thereof by means of the feeding conveyor 41 cooperating with the material reserve contained in the feeding hopper 35, thereby enabling a constant and continuous feeding of the first screener 11. It is worth mentioning though that the bulk material 3 can be unloaded directly at the inlet 19 of the first screener 11 by other appropriate feeding means such as an excavator, a loader, a mechanical shovel or even an auxiliary conveyor for example. The direct loading onto the first in screener 11 by these feeding means may be deemed more suitable if the bulk material 3 to be screened might risk of blocking in the feeding hopper 35 or either damage it if it contains pieces which are excessively large and/or excessively heavy.

The first screener is 11 intended, among other things, to remove from the bulk material 3 the inputs of large dimensions, i.e. the large-sized particles 5, such as large rocks, stumps, cement blocks and other residues for example, before conveying the rest of the material towards the second screener 13. The minimal dimension of the large-sized particles 5 that one wishes to screen from the bulk material 3 with the first screener 11 is selected according to one's particular needs by adjusting the spatial restrictions imposed by the screening medium of the first screener 11, such as for example, by varying the spacing between the fingers 65 in the case of a vibrating screener. For example, in order to screen large-sized particles 5 having a minimal dimension of about 3" and more, the spacing between the fingers 65 of the vibrating screener could be selected between approximately 2" and 3", as apparent to a person skilled in the art.

The substantial length of the first screener 11, made possible thanks to its positioning along the longitudinal axis of the length of the screening unit machine, and the shaking effect created by the sections of fingers 65 positioned on different levels, combine to increase the retention of the bulk material 3 on the vibrating screener and thus allow to maximize the quantity of material that passes through the fingers 65 of the vibrating screener. It is therefore possible to obtain an important production capacity while minimizing the losses of material (i.e. medium and small-sized particles 7,9 which would otherwise get undesirably screened along with the large-sized particles 5) at the exit of the vibrating screener before conveying the rest of the material towards the second screener 13.

The large-sized particles 5 which do not pass through the fingers 65 of the vibrating screener progress on the top of the latter until the end of the screener 11, thanks to its oscillatory movement, and fall either directly at the front of the screener 11 in order to form a moderately-sized pile of large-sized particles 5, or into a suitable piling conveyor (not shown) in order to be able to form a greater pile of large-sized particles 5, further away from the front end of the support frame 15 so as to not interfere with the mobile screening unit 1. The resulting pile of large-sized particles 5 can, among other things, be used for commercial or recycling purposes.

Furthermore, the mobile screening unit 1 according to the present invention is devised so that the medium-sized and small-sized particles 7,9 that pass through the screening media of the first screener 11, such as the fingers of a vibrating screener for example, fall directly onto the transition conveyor 45. This conveyor 45 is primarily intended to convey the material exempt of large-sized particles 5 towards the second screener 13, along a direction substantially parallel to the longitudinal axis of the support frame 15. As mentioned earlier, the second screener 13 may consist of a star screener, a rotating screener, a vibrating screener or any other type of suitable screener, as apparent to person skilled in the art. The object of the second screener 13 is to separate the medium-sized particles 7 from the small-sized particles 9 at an important production rate and without damaging the screening medium of the second screener 13 which is generally, by virtue of its intended purpose, more fragile than that of the first screener 11. Indeed, the screening media of screeners intended to screen coarser particles is often more robust than the screening media of screeners intended to screen finer particles.

Figure 6:
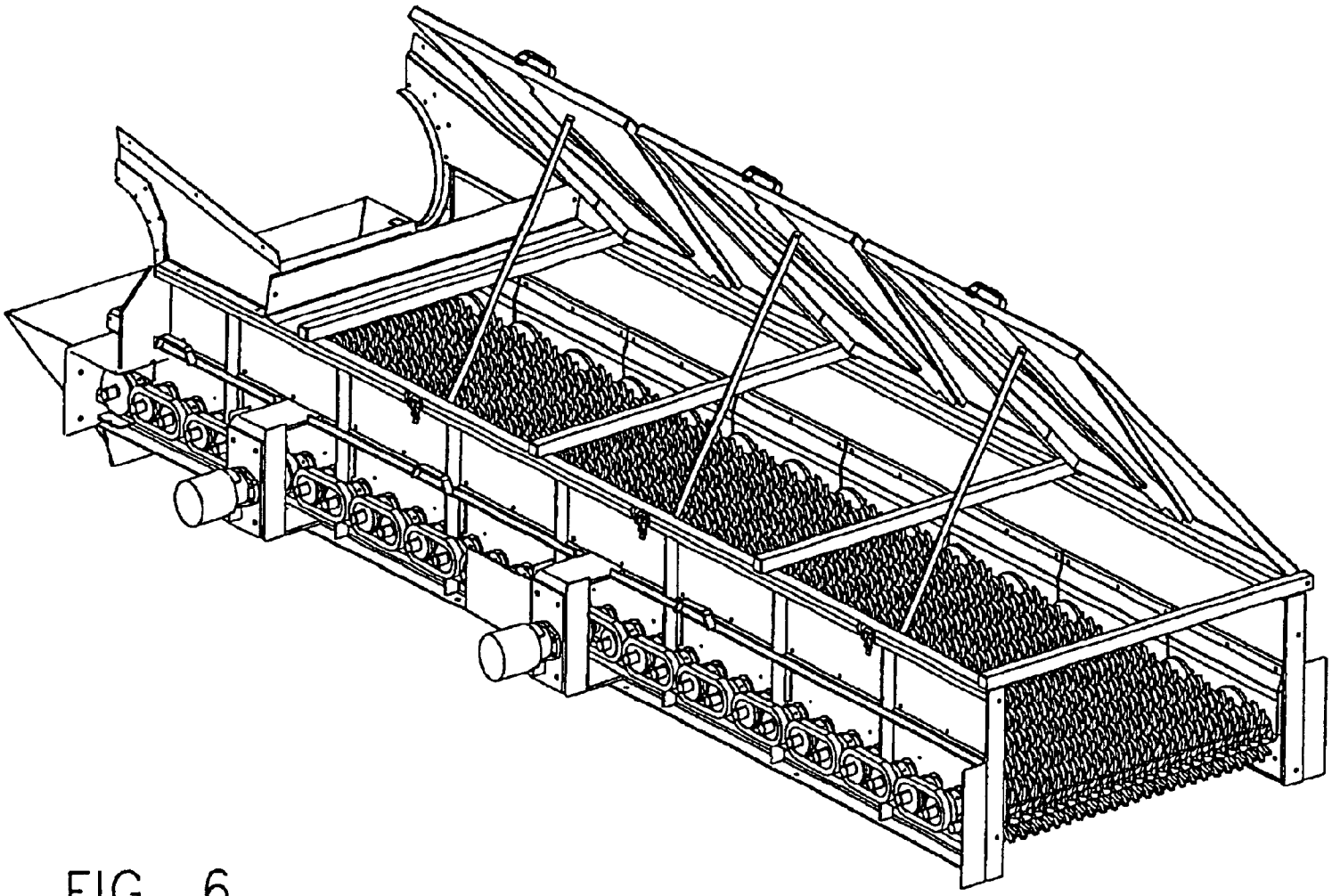
FIG. 6 is a perspective view of a star screener suitable for use with the mobile screening unit of FIG. 1.
Figure 8:
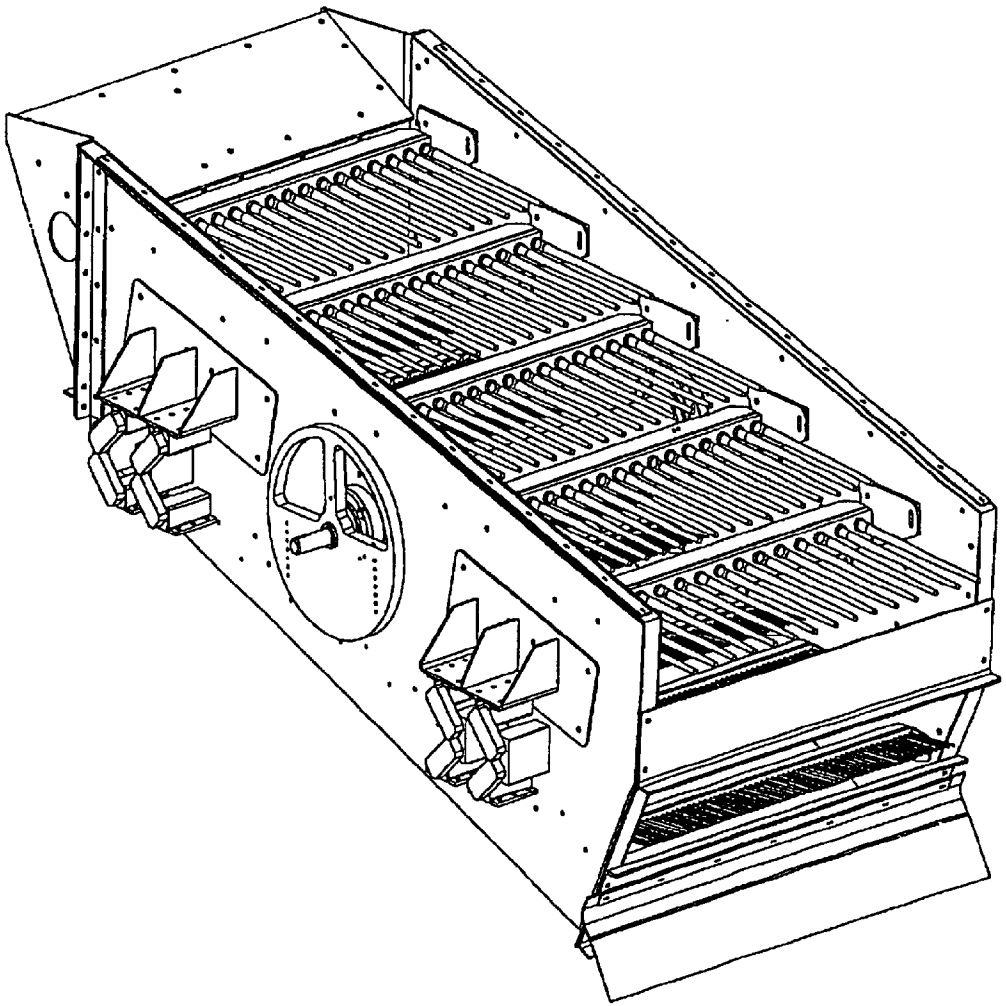
FIG. 8 is a perspective view of a double-stage vibrating screener suitable for use with the mobile screening unit of FIG. 1.

After the primary screening, the material released from the first screener 11 is preferably exempt of any large-sized particles 5, so that the secondary screening can be easily carried out by a rotating screener for example, without risking damaging the screening screens thereof. The secondary screening may also be carried out by means of a star screener such as the one shown in FIG. 6 for example, without the risk of damaging the stars or the star shafts thereof. Moreover, the secondary screening may be carried out by means of another vibrating screener for example. This latter approach turns out to be more efficient and quicker than with a rotating screener or a star screener when the material to be screened contains aggregates. Moreover, it is worth mentioning that the second screener 13 may also be a double-stage screener, such as the one shown in FIG. 8, comprising a first screening floor for screening the medium-sized particles 7 from the small-sized particles 9 and a second screening floor to further screen the small-sized particles 9 into coarser small-sized particles and finer small-sized particles, thereby enabling the mobile screening unit 1 to screen bulk material 3 into four different categories.

Hence, it can be easily understood from the above-discussed that both the first screener 11 and the second screener 13 may be selected from the group consisting of a vibrating screener, a disc screener, a star screener, a heavy-duty star screener, a rotating screener, a satellite screener, a gyratory screener, and a double-stage vibrating screener, depending on the applications intended for the mobile screening unit 1, and the nature of the particles 5,7,9 being screened, as apparent to a person skilled in the art. A vibrating screener is also known as a "screen box" and a rotating screener is also known as a "trommel screener". All of the above-mentioned types of screeners are well known in the art and thus, their working principles need not to be explained herein.

Since both the first and second screeners 11,13 are disposed substantially along the longitudinal axis 17 of the support frame 15 so as to enable increased screening lengths thereof, and therefore enable increased screening capacities thereof, and since the large-sized particles 5 of the bulk material 3 are removed at the first screener 11, the present invention enables to obtain an increased screening rate at the second screener stage, than what is possible with the mobile screening units known in the prior art which have screeners disposed otherwise.

According to the present invention, the material exempt of large-sized particles 5 which exits the first screener 11 is then conveyed to the second screener 13 along a direction substantially parallel to the longitudinal axis 17 of the support frame 15 in order to separate the medium-sized particles 7 from the small-sized particles 9 more adequately and at a high screening rate, preferably at a rate of 150 cubic yards/hour and more. The small-sized particles 9 which pass through the screening media of the second screener 13 (bed of stars, screens, sections of fingers, etc., depending on the type of second screener 13 being used) are then picked up by the recovering conveyor 47 that preferably passes under the secondary screener, as better shown in FIGS. 1 and 2. As explained earlier, the recovering conveyor 47 then preferably unloads itself at its outlet end 49 onto a piling conveyor 51 of small-sized particles. In the transportation configuration of the mobile screening unit 1 as shown in FIG. 1, the piling conveyor 51 of small-sized particles 9 preferably folds itself towards the front of the support frame 15 along the longitudinal axis thereof. In the working configuration of the mobile screening unit 1 as shown in FIG. 2, the piling conveyor 51 preferably unfolds itself perpendicularly to the longitudinal axis 17 of the support frame 15 in order to distance the piling of the small-sized particles 9 so as to produce a substantially-sized pile 53 of small-sized particles 9 which will be far away enough from the mobile screening unit 1 so as to not interfere therewith.

The medium-sized particles 7 that do not pass through the screening medium of the second screener 13 are rejected at the end of the latter in order to then be preferably picked up by the piling conveyor 55 of medium-sized particles 7 located along the longitudinal axis of the screening unit machine, at the rear end of the support frame 15, as better shown in FIG. 2. The piling conveyor 55 preferably folds itself at the rear end of the support frame 15 for transportation purposes, as better shown in FIG. 1. In order to distance the piling of the medium-sized particles 7 far away enough from the mobile screening unit 1 the piling conveyor 55 unfolds itself at the rear of the support frame 15 in the working position, as shown in FIG. 2. This configuration helps to create a larger pile of medium-sized particles than would be possible if no piling conveyor 55 was used.

When the screening cycle of the mobile screening unit 1 is over, the bulk material is then classified into at least three different piles, each pile containing particles of substantially the same size, as better shown in FIG. 3. The first pile 58 contains large-sized particles 5 and is preferably located at the front of the mobile screening unit 1, at the exit of the first screener 11. The second pile 57 contains medium-sized particles 7 and is preferably located at the rear of the mobile screening unit 1, at the exit of the second screener 13. The third pile 53 consists of small-sized particles 9, and is preferably located perpendicularly to the middle of the support frame 15 on the side of the mobile screening unit 1.

As better shown in FIG. 1, the support frame 15 preferably comprises a coupling device 59 for removably coupling the support frame 15 to hauling means (not shown) and a wheeled assembly 61 operatively connected to the support frame 15 for allowing transportation of the screening unit 1 by the hauling means, such as a tractor-trailer for example. Indeed, the mobile screening unit 1 preferably comprises a set of axles and wheels, a suspension system, a suitable braking system, and signaling devices, all of which are preferably compliant for safe transportation on roads and highways. The mobile screening unit 1 in its transportation configuration, as shown in FIG. 1, preferably complies also with road requirements in terms of length, width and height allowable, by virtue of its foldable components, as well as due to the longitudinal disposition of the first and second screeners 11,13.

As also shown in FIG. 1, when the mobile screening unit 1 is in the transportation configuration, the piling conveyor 51 of small-sized particles 9 is folded back along the longitudinal axis 17 of the support frame 15, the piling conveyor 55 of medium-sized particles is folded back on itself at the rear end of the support frame 15, and the side panels 43 of the feeding hopper 35 are also folded back in order to comply with the maximum height, length and width dimensions required by the Highway Code.

As shown in FIGS. 1 and 2, the support frame 15 also preferably comprises hydraulic support legs 63 for stabilizing the support frame 15 of the mobile screening unit 1 during stationary work operation of the screening unit 1.

As mentioned previously, it is worth mentioning once again that the second screener 13 may be a double-stage screener comprising a first screening floor for screening the medium-sized particles 7 from the small-sized particles 9 and a second screening floor to further screen the small-sized particles 9 into coarser small-sized particles and finer small-sized particles, thereby enabling the mobile screening unit 1 to screen bulk material 3 into four different categories.

According to the present invention, there is also provided a screening method for screening bulk material, the method comprising the steps of a) receiving bulk material containing large-sized, medium-sized, and small-sized particles; b) screening large-sized particles from medium-sized and small-sized particles along a first longitudinal direction; c) receiving medium-sized and small-sized particles obtained in a step (a); and d) screening medium-sized particles from small-sized particles along a second longitudinal direction substantially parallel to the first longitudinal direction.

Preferably, step (a) comprises the step of receiving the bulk material in a direction substantially parallel to the first longitudinal direction. Preferably also, step (c) comprises the step of receiving medium-sized and small-sized particles in a direction substantially parallel to the second longitudinal direction.

As may now be appreciated, the mobile screening unit 1 according to the present invention is an improvement over the prior art in that, as discussed hereinabove, both the first and second screeners 11,13 are disposed substantially along the longitudinal axis 17 of the support frame 15 so as to enable increased screening lengths thereof, and therefore enable increased screening capacities thereof, and since the large-sized particles 5 of the bulk material 3 are removed at the first screener 11, the present invention enables to obtain an increased screening rate at the second screener stage, than what is possible with the screening units known in the prior art which have screeners disposed otherwise.

Furthermore, the mobile screening unit 1 according to the present invention is also advantageous in that the flow of the bulk material 3 into the first screener 11 is carried out in the same direction as the flow of the material in the feeding hopper 35, that is, substantially along the longitudinal axis 17 of the support frame 15. This enables to obtain a greater first screener length when compared to a screening unit having a first screener whose flow of material is done perpendicularly to the flow of product in the material reserve (feeding hopper) and thus perpendicularly to the longitudinal axis of the machine. As discussed previously for the prior art, a flow of material in a first screener done perpendicularly to the flow of material in the material reserve will often result in an overflow of material in the first screener. The disposition of the first screener 11 according to the present invention, and the screening carried out therealong, as explained hereinabove, overcome the above-mentioned problem associated to the prior art.

The mobile screening unit 1 according to the present invention is also advantageous over the prior art in that the longitudinal disposition of the first and second screeners and of the conveyors allow for an easier maintenance, repair and/or part replacement thereof.

The mobile screening unit 1 according to the present invention is also advantageous over the prior art in that the longitudinal disposition of the screeners and of the conveyors enable to increase substantially the length of the screeners, while respecting the maximal dimensions allowed by the Highway Code, contrary to the machines whose first screener lengths are perpendicular to the longitudinal axis of the screening unit (the length of the screener is thus limited by the width of the screening unit).

Furthermore, this increase of the length of the screeners due to their longitudinal disposition according to the present invention enables to unload more material at once on the screeners while having an increased quality of screening, which results in an increased production capacity and rate, without damaging the screeners used to obtain particles of smaller sizes from bulk material containing large-sized particles, such as big rocks, stumps, cement blocks and the like.

Of course, numerous modifications could be made to the above-described embodiments without departing from the scope of the invention as defined in the appended claims.

What is claimed is:

1. A mobile screening unit for screening bulk material, said screening unit comprising:

an elongated mobile support frame having a longitudinal axis;

a first screener mounted to the support frame and extending longitudinally thereon, the first screener having:

an inlet for receiving bulk material containing large-sized, medium-sized, and small-sized particles, a first outlet for releasing large-sized particles, and a second outlet for releasing medium-sized and small-sized particles, the first screener being used for screening the bulk material along a first direction substantially parallel to the longitudinal axis of the support frame;

a second screener mounted to the support frame and extending longitudinally thereon, the second screener having:

an inlet for receiving medium-sized and small-sized particles conveyed from the first screener, a first outlet for releasing medium-sized particles, and a second outlet for releasing small-sized particles, the second screener being used for screening the medium-sized particles from the small-sized particles along a second direction substantially parallel to the longitudinal axis of the support frame;

a feeding hopper mounted to the support frame for accumulating bulk material, the feeding hopper having an inlet for receiving bulk material and an outlet for releasing bulk material;

a feeding conveyor positioned to receive the bulk material released from the outlet of the feeding hopper and convey the same in the first direction to the inlet of the first screener; and a transition conveyor mounted to the support frame and extending longitudinally thereon, the transition conveyor being positioned to receive the medium-sized and small-sized particles released from the second outlet of the first screener and convey the same in the second direction to the inlet of the second screener.

2. A mobile screening unit according to claim 1, comprising a recovering conveyor mounted to the support frame and extending longitudinally thereon, the recovering conveyor being positioned to receive the small-sized particles released from the second outlet of the second screener and convey the same in the first direction to an outlet end thereof.

3. A mobile screening unit according to claim 2, comprising a piling conveyor mounted to the support frame for receiving the small-sized particles from the outlet end of the recovering conveyor and forming a pile of small-sized particles aside from the support frame, the piling conveyor being movable with respect to the support frame between a folded position where it is folded against the support frame and an extended position where it extends in perpendicular to the longitudinal axis of the support frame.

4. A mobile screening unit according to claim 1, comprising a piling conveyor mounted to a rear end of the support frame for receiving the medium-sized particles released from the first outlet of the second screener and forming a pile of medium-sized particles at the rear of the support frame, said piling conveyor being movable between a folded position where it is folded against the rear end of the support frame and an extended position where it extends in the same line as the support frame.

5. A mobile screening unit according to claim 1, wherein the first screener is selected from the group consisting of a vibrating screener, a disc screener and a heavy-duty star screener.

6. A mobile screening unit according to claim 1, wherein the first screener is a vibrating screener.

7. A mobile screening unit according to claim 1, wherein the second screener is selected from the group consisting of a vibrating screener, a disc screener, a star screener, a rotating screener, a satellite screener, a gyratory screener, and a double-stage vibrating screener.

8. A mobile screening unit according to claim 1, wherein the second screener is a rotating screener.

9. A mobile screening unit according to claim 1, wherein the feeding hopper comprises retractable rear and lateral side panels.

10. A mobile screening unit according to claim 1, wherein the support frame comprises:

a coupling device for removably coupling the support frame to hauling means; and a wheeled assembly operatively connected to the support frame for allowing transportation of the screening unit by the hauling means.

11. A mobile screening unit according to claim 1, wherein the support frame comprises hydraulic support legs for stabilizing the support frame of the screening unit during stationary working operation of the screening unit.

12. A mobile screening unit according to claim 1, wherein the second screener is a double-stage screener comprising a first screening floor for screening the medium-sized particles from the small-sized particles and a second screening floor to further screen the small-sized particles into coarser small-sized particles and finer small-sized particles.

13. A mobile screening unit according to claim 1 comprising:

a recovering conveyor mounted to the support frame and extending longitudinally thereon, the recovering conveyor being positioned to receive the small-sized particles released from the second outlet of the second screener and convey the same in the first direction to an outlet end thereof;

a first piling conveyor mounted to the support frame for receiving the small-sized particles from the outlet end of the recovering conveyor and forming a pile of small-sized particles aside from the support frame, the piling conveyor being movable with respect to the support frame between a folded position where it is folded against the support frame along the longitudinal axis thereof and an extended position where it extends in perpendicular to the longitudinal axis of the support frame; and a second piling conveyor mounted to a rear end of the support frame for receiving the medium-sized particles released from the first outlet of the second screener and forming a pile of medium-sized particles at the rear of the support frame, said piling conveyor being movable between a folded position where it is folded against the rear end of the support frame and an extended position where it extends in the same line as the support frame.

* * * * *